US010113334B2

(12) United States Patent
Liao

(10) Patent No.: US 10,113,334 B2
(45) Date of Patent: Oct. 30, 2018

(54) ELECTRIC STRIKE LOCK

(71) Applicant: Li-Shih Liao, Taoyuan (TW)

(72) Inventor: Li-Shih Liao, Taoyuan (TW)

( * ) Notice: Subject to any disclaimer, the term of this patent is extended or adjusted under 35 U.S.C. 154(b) by 106 days.

(21) Appl. No.: 15/201,750

(22) Filed: Jul. 5, 2016

(65) Prior Publication Data

US 2017/0107740 A1 Apr. 20, 2017

(30) Foreign Application Priority Data

Oct. 16, 2015 (TW) ..... 104216592 U

(51) Int. Cl.
*E05B 15/02* (2006.01)
*E05B 47/00* (2006.01)

(52) U.S. Cl.
CPC ..... *E05B 47/0046* (2013.01); *E05B 15/025* (2013.01)

(58) Field of Classification Search
CPC ..... E05B 47/0046; E05B 15/025
See application file for complete search history.

(56) References Cited

U.S. PATENT DOCUMENTS 6,299,225 B1 * 10/2001 Chang ..... E05B 47/0047 292/341.16
6,874,830 B2 * 4/2005 Bashford ..... E05B 47/0047 292/201

* cited by examiner

*Primary Examiner* — Kristina R Fulton
*Assistant Examiner* — Thomas L Neubauer
(74) *Attorney, Agent, or Firm* — Rosenberg, Klein & Lee

(57) ABSTRACT

An electric strike lock has a strike body, a latch having a latch bolt and a deadlatch, a keeper having a stop block to abut against the deadlatch, and an adjusting section having an elliptical adjusting hole corresponding to a screw hole on the keeper and an adjusting piece fitting a shape of the elliptical adjusting hole and having an eccentric through hole for an adjusting screw to pass through and to be screwed to the screw hole. The keeper further combined with a solenoid which has a movable rod passing through the keeper and engaging the stop block, and the elliptical adjusting hole has its major axis arranged in the same direction as an axis of the solenoid. By changing the placement of the adjusting piece, the positions of the stop block and the deadlatch can be altered to adjust the strike lock into a fail-safe or a fail-secure strike lock.

3 Claims, 6 Drawing Sheets

ELECTRIC STRIKE LOCK

BACKGROUND OF THE INVENTION

1. Field of the Invention

The present invention relates to an electric strike lock, particularly to one that is eccentrically positioned for adjusting the electric strike lock to be fail-safe or fail-secure.

2. Description of the Related Art

As we know, electric strike locks are basically categorized into fail-secure locks and fail-safe locks. At early stages the type of the strike locks is unalterable, and then there are adjusting structures for electric strike locks to be adjusted when needed. However, the structures and steps in the adjustment are rather complicated and sophisticated, making it inconvenient to alter, and the manufacturing process of such structures consumes time as well.

SUMMARY OF THE INVENTION

The present invention aims to solve the inconveniences of altering a strike lock into fail-safe or fail-secure strike lock and to provide an electric strike lock that can be adjusted between the two types by simple adjustment in the structure thereof.

To achieve the object mentioned above, the present invention comprises a strike body engaged with a cover plate; a latch having a latch bolt and a deadlatch, said latch engaging a spring and being disposed inside the strike body together with said spring; a keeper having a screw hole and a stop block in correspondence to the deadlatch and connecting to a solenoid which has a movable rod engaging through the keeper and engaging the stop block; whereby the stop block is pushed by the solenoid and moves between a position blocking the latch and a position unblocking the latch; and an adjusting section including an elliptical adjusting hole on the cover plate in correspondence to the screw hole, and an elliptical adjusting piece corresponding to the adjusting hole, said adjusting piece having an eccentric through hole for an adjusting screw to pass through and to be screwed with the screw hole, a major axis of said adjusting hole arranged in the same direction as an axis of the solenoid; whereby the eccentric through hole enables the adjusting piece to be disposed in two different positions by rotating 180° for adjusting the electric strike lock to be fail-safe or fail-secure.

Moreover, the strike body includes a lower section and an upper section. The upper section engages the lower section and has a first installation space for the latch to be disposed therein, a second installation space for the keeper to be disposed therein, and a passage connecting the first and second installation space; and the lower section has an opening for the latch bolt to operate. The deadlatch is exposed by the passage and the latch bolt is exposed by the opening; both of which can be seen from outside.

With the structures disclosed above, the present invention is able to be conveniently adjusted into a fail-safe or a fail-secure strike lock simply by rotating the adjusting piece, thus overcoming the inconveniences of adjustment of an electric strike lock in the prior art.

DETAILED DESCRIPTION OF THE PREFERRED EMBODIMENT

Figure 1:
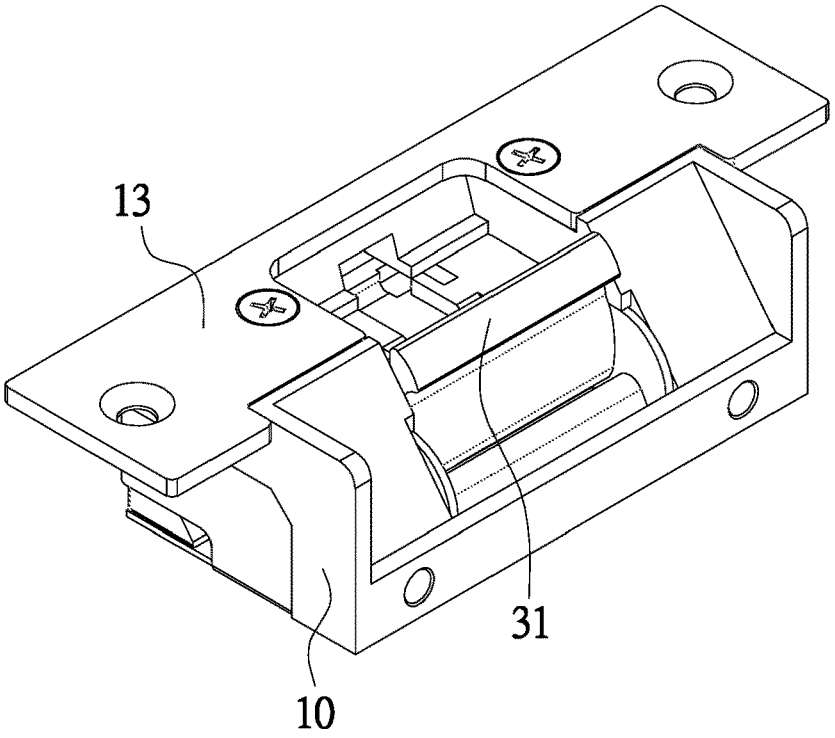
FIG. 1 is a perspective view of the present invention.
Figure 2:
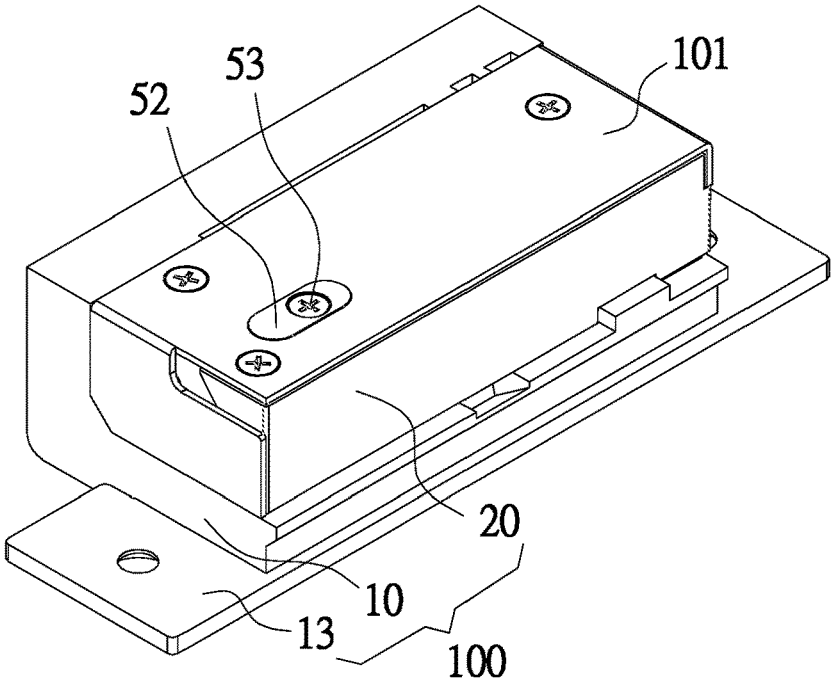
FIG. 2 is a reverse view of FIG. 1.
Figure 3:
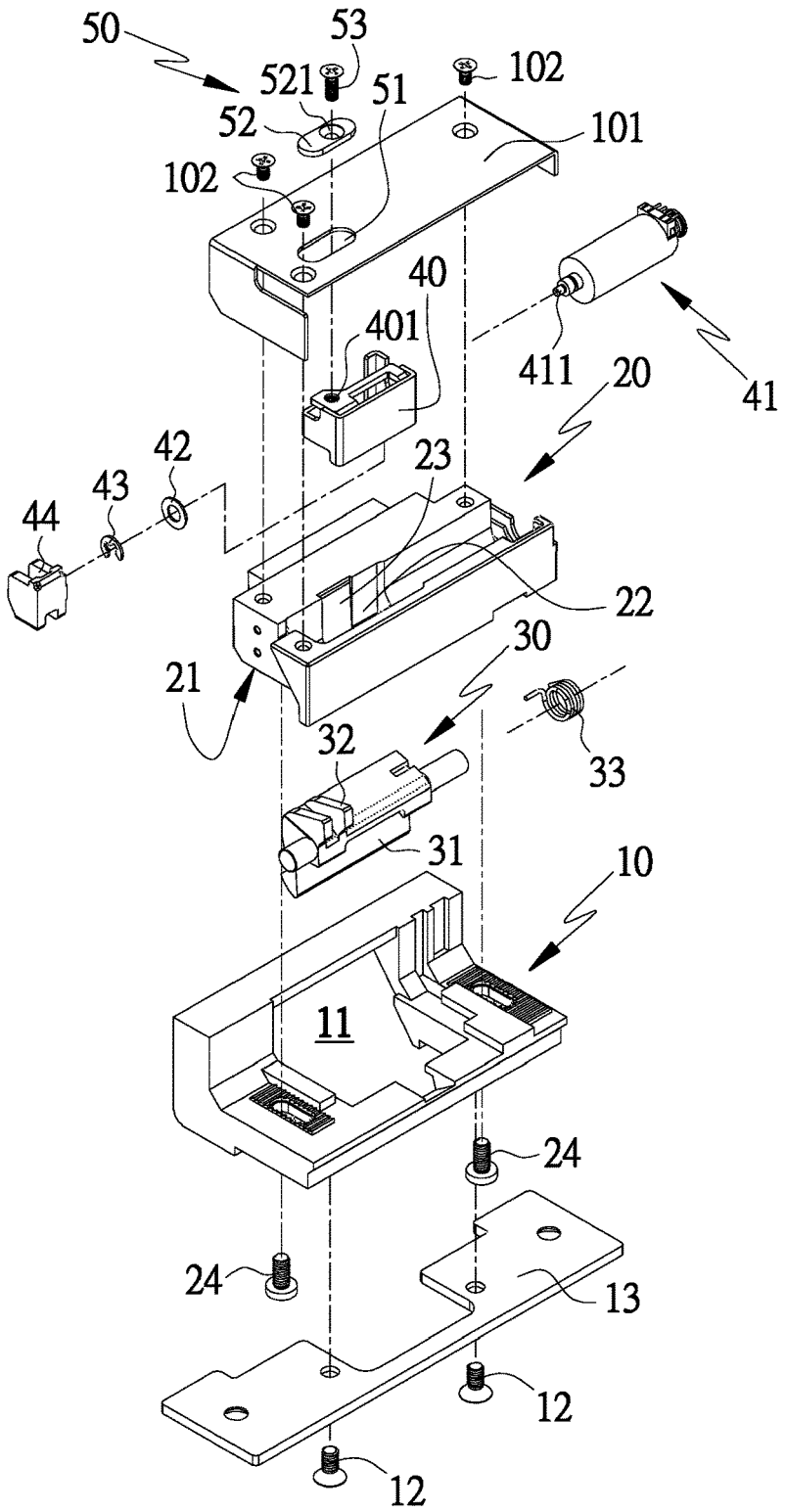
FIG. 3 is an exploded view of the present invention.

FIGS. 1-3 illustrate the present invention in an embodiment. In the embodiment, the present invention mainly comprises a strike body 100, a latch 30, a keeper 40, and an adjusting section 50.

The strike body 100 is engaged with a cover plate 101 by a plurality of screws 102 and includes a lower section 10 and an upper section 20 disposed therein. The lower section 10 has an opening 11 and engages a faceplate 13 by a plurality of screws 12. The upper section 20 engages the lower section 10 by a plurality of screws 24 and has a first installation space 21 for the latch 30 to be disposed therein, a second installation space 22 for the keeper 40 to be disposed therein, and a passage 23 connecting the first and second installation space 21, 22. In an embodiment, the lower section 10 can also extend and form a faceplate 13 in one-piece without screws or further engagement.

The latch 30 has a latch bolt 31 and a deadlatch 32. It further engages a spring 33 to be disposed inside the first installation space 21 together with the spring 33. The latch bolt 31 and the deadlatch 32 are respectively exposed in the opening 11 and the passage 23.

The keeper 40 has a screw hole 401 and a stop block 44 in correspondence to the deadlatch 32 and connecting to a solenoid 41 by a bumper piece 42 and a C ring 43. The solenoid 41 further has a movable rod 411 passing through the keeper 40 and engaging the stop block 44. Thereby the stop block 44 is pushed by the solenoid 41 and moves between a position blocking the latch 30 and a position unblocking the latch 30. The keeper 40 is disposed in the second installation space 22 and is covered by the cover plate 101.

The adjusting section 50 includes an elliptical adjusting hole 51 on the cover plate 101 in correspondence to the screw hole 401, and an elliptical adjusting piece 52 corresponding to the adjusting hole 51. A major axis of the adjusting hole 51 is arranged in the same direction as an axis of the solenoid 41, and the adjusting piece 52 has an eccentric through hole 521 for an adjusting screw 53 to pass through and to be screwed with the screw hole 401.

With the structure disclosed, the eccentric through hole 521 enables the adjusting piece 52 to be disposed in two different positions by rotating 180° for adjusting the electric strike lock to be fail-safe or fail-secure.

Figure 4:
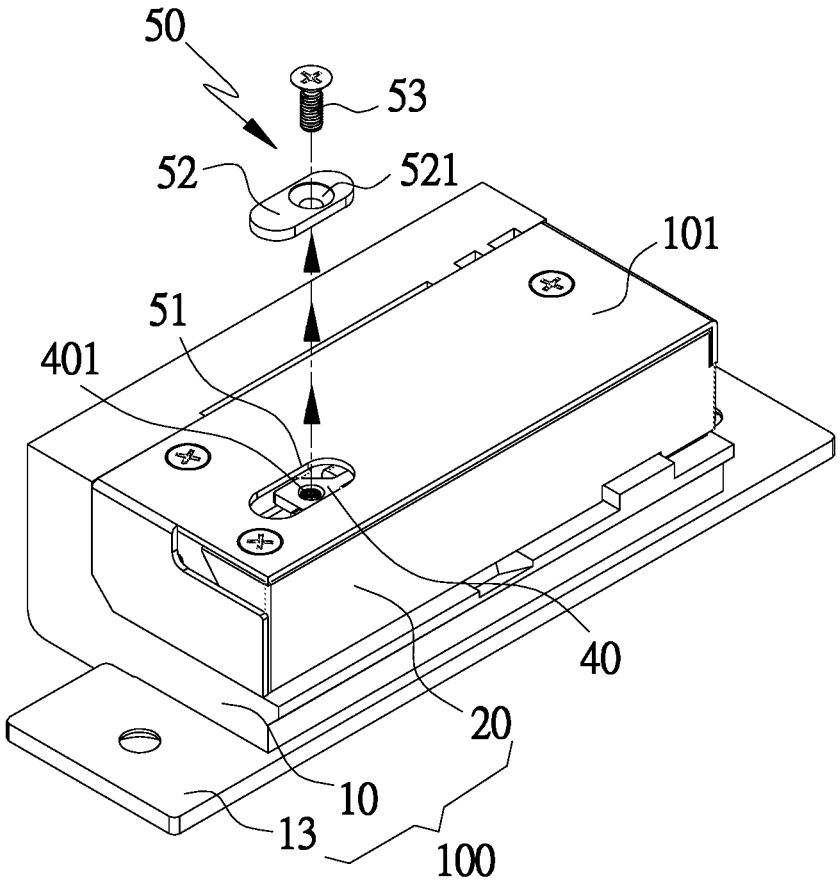
FIG. 4 is a schematic diagram of the present invention illustrating an adjustment of an adjusting piece thereof in an embodiment.
Figure 5:
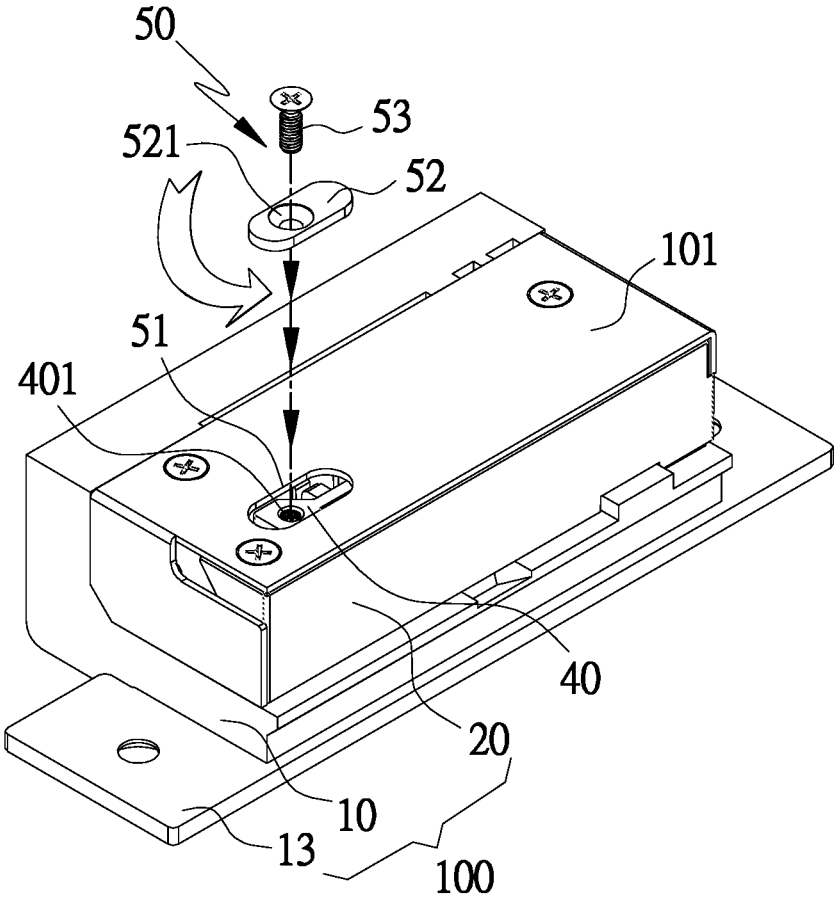
FIG. 5 is another schematic diagram of the present invention illustrating further adjustment of the adjusting piece thereof in an embodiment.
Figure 6:
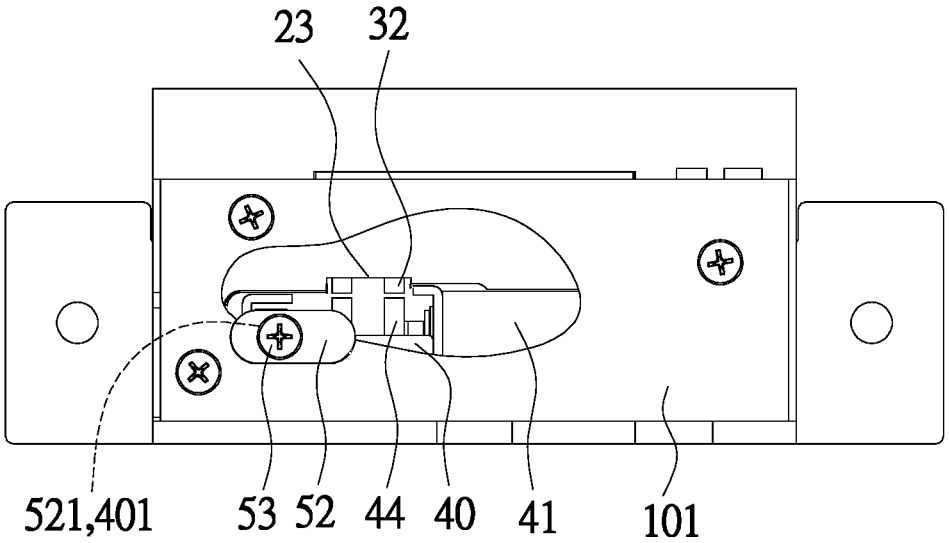
FIG. 6 is a schematic diagram of the present invention as a fail-secure strike lock.

Referring to FIGS. 4-6, the electric strike lock is adjusted to be fail-secure. In FIG. 4, the adjusting screw 53 is removed from the screw hole 401; then the adjusting piece 52 is removed from the adjusting hole 51 and rotated 180° as in FIG. 5 for the through hole 521 to be eccentric to the left. The keeper 40 is adjusted in accordance to the position of the through hole 521 for the screw hole 401 to be aligned with the through hole 521, and then the adjusting piece 52 is placed back to the adjusting hole 51 and the adjusting screw 53 is screwed back into the screw hole 401. Thereby the present invention is a fail-secure strike lock as illustrated in FIG. 6. That is, when electricity fails to pass through, the stop block 44 is blocking the deadlatch 32 for the latch 30 to be unable to turn and therefore the present invention is locking up. When electricity passes through, the solenoid 41 would operate to stretch the movable rod 411 and push the stop block 44 forward. The deadlatch 32 is therefore free for the latch 30 to turn and unlock the present invention.

Figure 7:
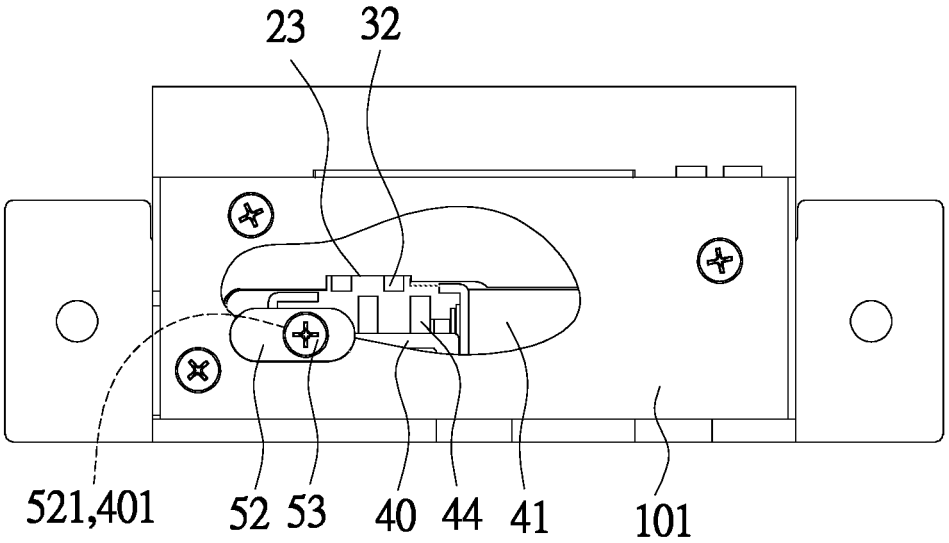
FIG. 7 is a schematic diagram of the present invention as a fail-safe strike lock.

Similarly, when adjusting the electric strike lock to be fail-safe, simply remove the adjusting screw 53 from the screw hole 401. Then remove the adjusting piece 52 from the adjusting hole 51 and rotated 180° for the through hole 521 to be eccentric to the right; adjust the keeper 40 to align the screw hole 401 with the through hole 521. Finally place back the adjusting piece 52 and screw back the adjusting screw 53. Thereby the present invention is a fail-safe strike lock as illustrated in FIG. 7. When electricity fails to pass through, the stop block 44 unblocks the deadlatch 32 and enables the latch 30 to turn freely; while when electricity passes through, the solenoid 41 would operate to stretch the movable rod 411 and push the stop block 44 for blocking the deadlatch 32, thus locking up the latch 30.

Figure 8:
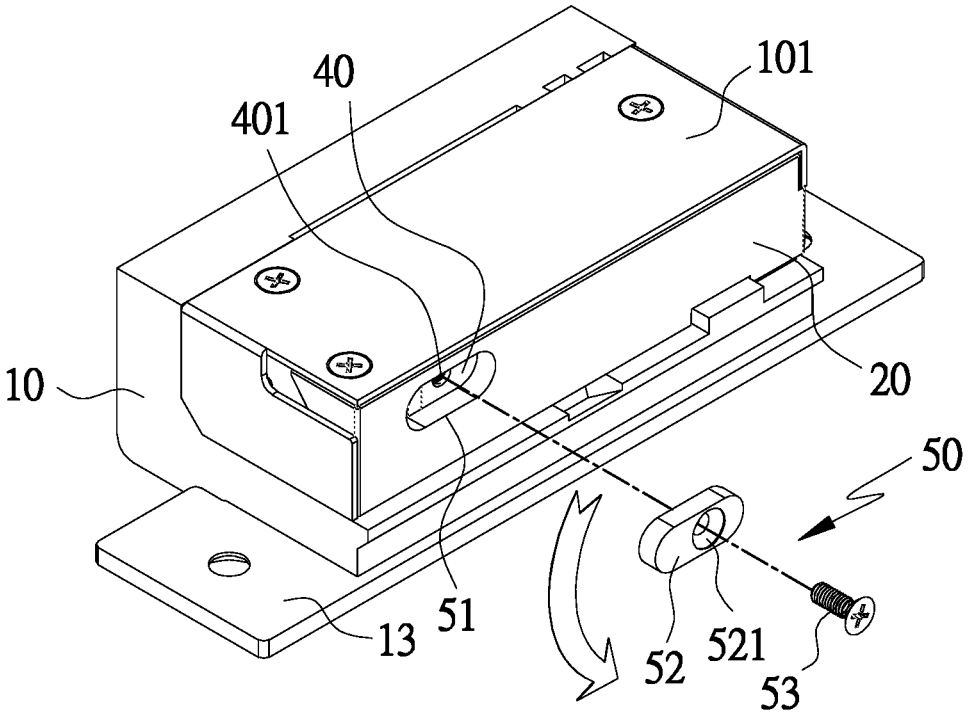
FIG. 8 is a schematic diagram of the present invention illustrating an adjustment of the adjusting piece thereof in another embodiment.

Further referring to FIG. 8, in another embodiment, the elliptical adjusting hole 51 is arranged on the upper section 20 of the strike body 100 for the adjusting piece 52 to engage, and the adjusting section 50 is therefore arranged in accordance with the position of the adjusting hole 51. In this embodiment, the electric strike lock still operates in the same way as disclosed above.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An electric strike lock, comprising:

a strike body engaged with a cover plate;

a latch having a latch bolt and a deadlatch, said latch engaging a spring and being rotatably disposed inside the strike body together with said spring;

a keeper having a screw hole and a stop block displaceably disposed within the keeper, the stop block being connected to a solenoid which has a movable rod passing through the keeper and engaging the stop block, the stop block being displaced by the solenoid to move between a first position aligned with the deadlatch to block rotation of the latch and a second position unaligned with the deadlatch to allow rotation of the latch; and an adjusting section including an elliptical adjusting hole formed through the cover plate in correspondence to the screw hole of the keeper, and an elliptical adjusting piece shaped in correspondence to the elliptical adjusting hole, said elliptical adjusting piece having an eccentrically-positioned through hole and an adjusting screw passing therethrough and to threadedly engage the screw hole of the keeper, a major axis of said elliptical adjusting hole extending in correspondence with an operating axis of the solenoid;

the elliptical adjusting piece being inserted into the elliptical adjusting hole in one of two orientations to locate the eccentrically-positioned through hole in a selected one of two locations for correspondingly locating the keeper relative to the solenoid and therewith disposing the stop block initially in either the first position or the second position and thereby set the electric strike lock as being fail-safe or fail-secure.

2. The electric strike lock as claimed in claim 1, wherein the strike body includes a lower section and an upper section, said upper section engaging the lower section and having a first installation space for the latch to be disposed therein, a second installation space for the keeper to be disposed therein, and a passage connecting the first and second installation space, and said lower section having an opening for the latch bolt to operate.

3. The electric strike lock as claimed in claim 2, wherein the lower section is further engaged with a faceplate which is screwed on a jamb of a door for placement of the electric strike lock.

* * * * *